US008885867B1

(12) United States Patent
Tai et al.

(10) Patent No.: US 8,885,867 B1
(45) Date of Patent: Nov. 11, 2014

(54) PORTABLE ELECTRONIC DEVICE

(71) Applicant: Acer Incorporated, New Taipei (TW)

(72) Inventors: Kuei-Ting Tai, New Taipei (TW); Jia-Ren Chang, New Taipei (TW); Yu-Cheng Huang, New Taipei (TW); Shu-Yi Kung, New Taipei (TW)

(73) Assignee: Acer Incorporated, New Taipei (TW)

( * ) Notice: Subject to any disclaimer, the term of this patent is extended or adjusted under 35 U.S.C. 154(b) by 0 days.

(21) Appl. No.: 13/971,990

(22) Filed: Aug. 21, 2013

(30) Foreign Application Priority Data

Jun. 10, 2013 (TW) ..... 102120478 A

(51) Int. Cl.
*H04R 25/00* (2006.01)

(52) U.S. Cl.
USPC ..... 381/388; 381/333

(58) Field of Classification Search
USPC ..... 381/152, 306, 333, 365, 388, 431
See application file for complete search history.

(56) References Cited

U.S. PATENT DOCUMENTS 8,000,489 B2 * 8/2011 Eaton et al. ..... 381/333
8,160,289 B2 * 4/2012 Park ..... 381/388
8,682,017 B2 * 3/2014 Gelbart et al. ..... 381/333

* cited by examiner

*Primary Examiner* — Suhan Ni
(74) *Attorney, Agent, or Firm* — McClure, Qualey & Rodack, LLP

(57) ABSTRACT

A portable electronic device includes a cabinet and a speaker. The cabinet has a rear portion, a side wall connected to the rear portion, and an acoustic hole disposed on the side wall. The speaker is disposed in the cabinet, and has a loudspeaker membrane extending along a plane located between the acoustic hole and the rear portion. Thus, the sound quality of the portable electronic device is improved, and the thickness thereof is decreased.

11 Claims, 7 Drawing Sheets

PORTABLE ELECTRONIC DEVICE

CROSS-REFERENCE TO RELATED APPLICATIONS

This Application claims priority of Taiwan Patent Application No. 102120478, filed on Jun. 10, 2013, the entirety of which is incorporated by reference herein.

BACKGROUND OF THE INVENTION

1. Field of the Invention

The present disclosure relates to a portable electronic device, and in particular, to a portable electronic device having a speaker.

2. Description of the Related Art

As shown in FIG. 1, in order to have a larger display screen, the display 110 of a conventional smart mobile phone 100 occupies almost the entire area of the front side thereof, and thus the speaker 120 is only stacked over the display 110. Moreover, in order to decrease the thickness of the smart mobile phone 100, the speaker 120 is arranged parallel to the display 110, and an acoustic hole 132 is located in the back board 131 of the casing 130, facing an acoustic surface 121 on the speaker 120. However, during use of the smart mobile phone 100, the display 110 faces the user, and therefore the sound quality of the smart mobile phone 100 is decreased due to the acoustic hole 132 being located in the back board 131 of the casing 130.

As shown in FIG. 2, in another conventional art, the location of the acoustic hole 132 is formed on the side board 133 of the casing 130 for improving the sound quality of the smart mobile phone 100 and to solve the above problem. Further, for the sound generated by the speaker 120 transmitting to the acoustic hole 132, a channel 134 is formed between the acoustic surface 121 and the back board 131, and the acoustic hole 132 is located above the acoustic surface 121 and communicates with the channel 134. However, in the structure, the thickness of the smart mobile phone 100 is increased because of the height of the acoustic hole 132.

In addition, the conventional speaker 120 is fixed on a main PCB (printed circuit board) 140. As shown in FIGS. 1 and 2, since the main PCB 140 is located between the speaker 120 and the display 110, the thickness of the smart mobile phone 100 is increased.

BRIEF SUMMARY OF THE INVENTION

To solve the described problems, the present disclosure provides a portable electronic device having the acoustic hole located at the side wall of the cabinet, and the thickness of the cabinet is reduced.

The present disclosure provides a portable electronic device including a cabinet and an acoustic assembly. The cabinet has a rear portion, a side wall connected to the rear portion, and an acoustic hole located at the side wall. The acoustic assembly includes a base and a speaker. The base, disposed in the cabinet, has a receiving portion and an inclined portion connected to the receiving portion. A channel is formed between the inclined portion and the side wall. The speaker is disposed in the receiving portion and has a loudspeaker membrane.

A resonant chamber is formed between the loudspeaker membrane and the rear portion, and the channel communicates with the resonant chamber and the acoustic hole. In addition, the loudspeaker membrane is extended along a plane, which is located between the acoustic hole and the rear portion, and the acoustic hole and the plane are separated by a predetermined distance.

In conclusion, the acoustic hole of the portable electronic device of the present disclosure is located at the side wall of the cabinet to increase the sound quality of the portable electronic device. In addition, by the resonant chamber and the channel formed between the base and the cabinet, the location of the acoustic hole can be lower than the loudspeaker membrane of the speaker. Thus, the thickness of the portable electronic device is decreased.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 2:
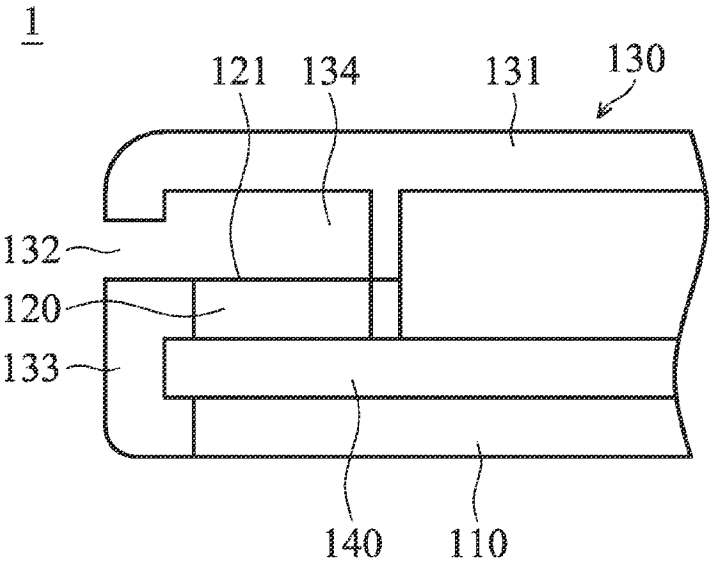
FIG. 2 ( PRIOR ART )
FIGS. 1 and 2 are schematic views of a conventional smart mobile phone.
Figure 1:
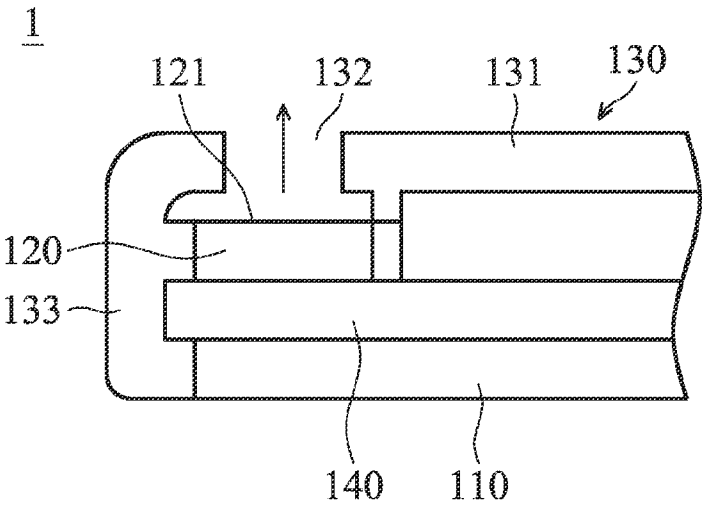
FIG. 1 ( PRIOR ART )
Figure 3:
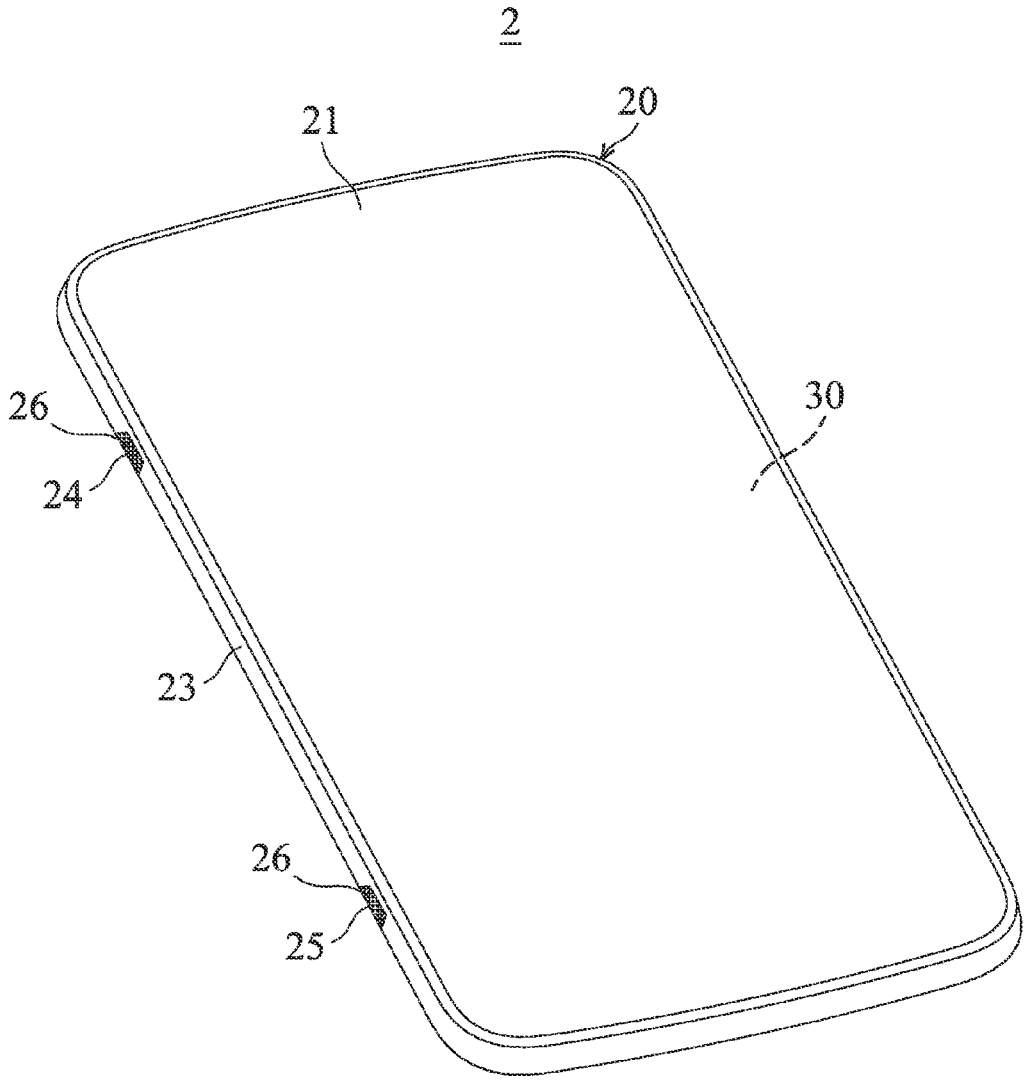
FIG. 3 is a perspective view of a portable electronic device of the present disclosure.
Figure 4:
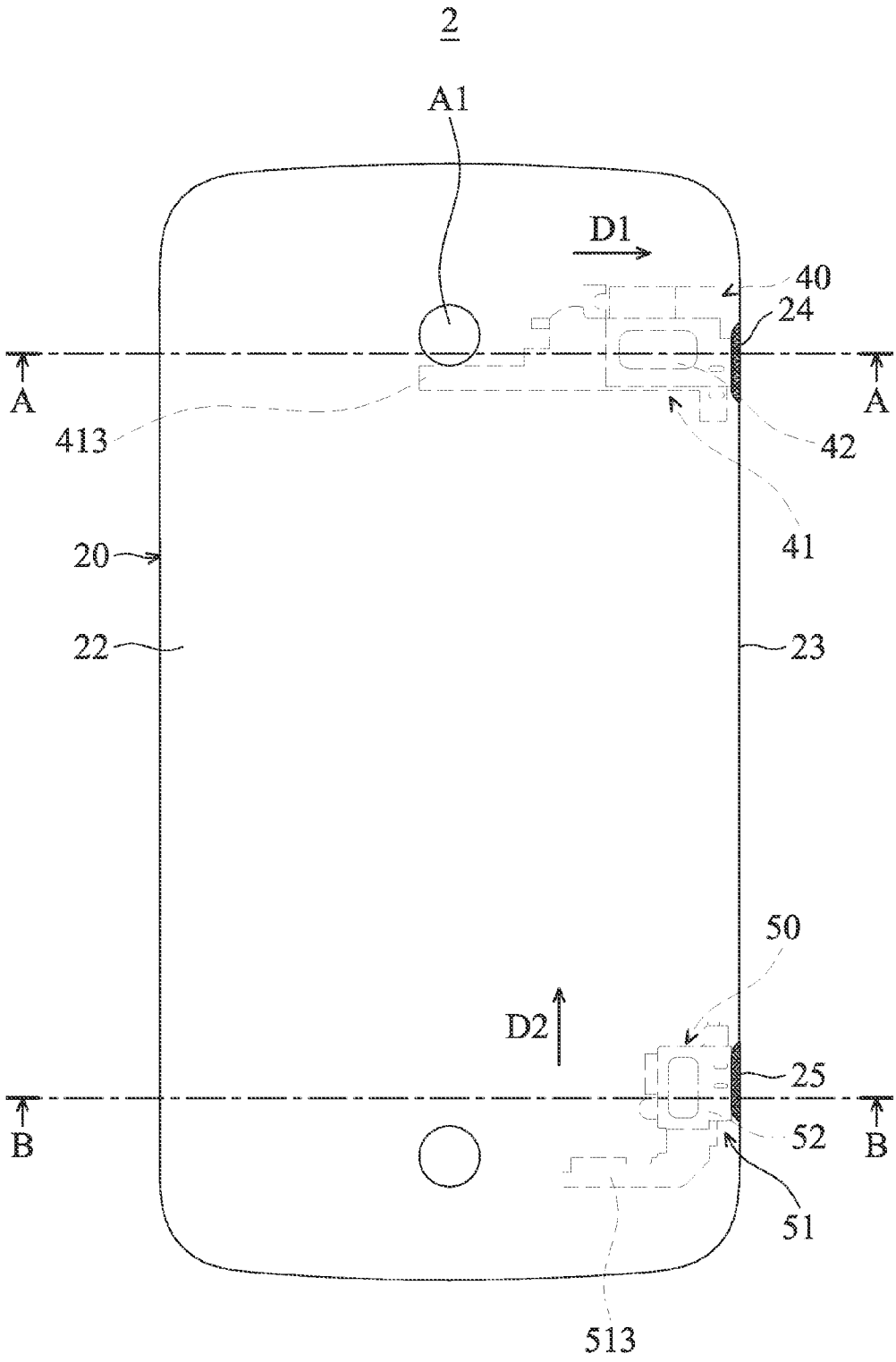
FIG. 4 is a rear view of the portable electronic device of the present disclosure.
Figure 5:
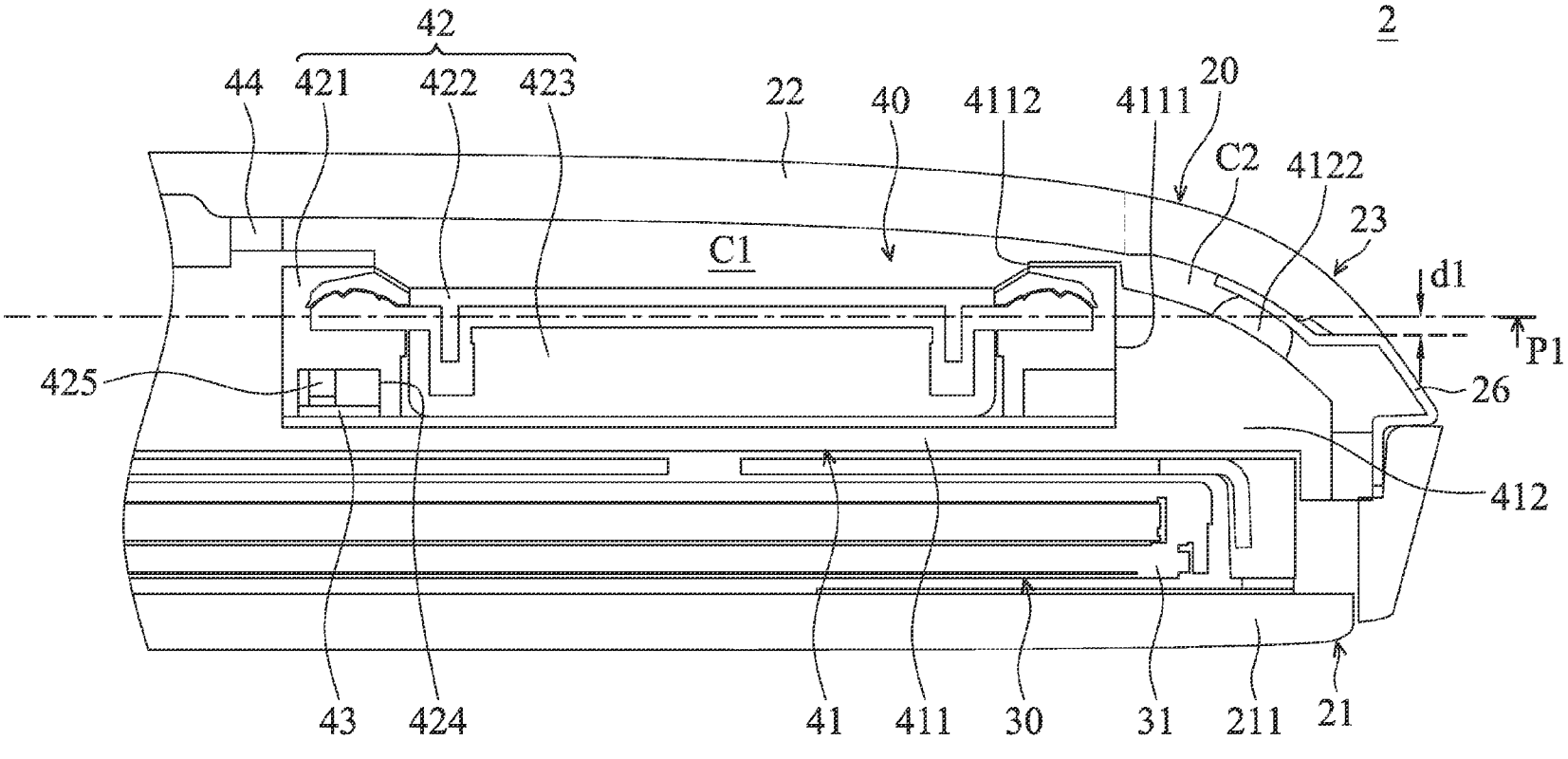
FIG. 5 is a cross-sectional view along the line AA of FIG. 4.

FIG. 3 is a perspective view of a portable electronic device 2 of the present disclosure. FIG. 4 is a rear view of the portable electronic device 2 of the present disclosure. FIG. 5 is a cross-sectional view along the line AA of FIG. 4. The portable electronic device 2 may be a smart mobile phone or a tablet computer. The portable electronic device 2 includes a cabinet 20, a display 30, and two acoustic assemblies 40 and 50. The cabinet 20 includes a front portion 21, a rear portion 22, a side wall 23, and two acoustic holes 24 and 25, and two meshes 26. The front portion 21 is opposite the rear portion 22, and the side wall 23 is connected to the front portion 21 and the rear portion 22.

The acoustic holes 24 and 25 are respectively disposed on two ends of the side wall 23, and the distance between the acoustic holes 24 and 25 is from 7 cm to 15 cm. In the embodiment, the distance is about 10 cm. The mesh 26 is disposed on the acoustic holes 24 and 25 to prevent dirt from entering into the cabinet 20 via the acoustic holes 24 and 25.

The front portion 21 includes a protection board 221. The display 30 includes a display panel 31 located between the protection board 221 and the rear portion 22. The acoustic assemblies 40 and 50 are disposed in the cabinet 20, and located between the rear portion 22 and the display panel 31. The acoustic assembly 40 corresponds to the acoustic hole 24, and the acoustic assembly 50 corresponds to the acoustic hole 25.

Since the acoustic holes 24 and 25 are located at the side wall 23 of the cabinet 20, and separated from each other, the stereo sound generated by the portable electronic device 2 is greater when users watch movies shown on the display 30 by putting the portable electronic device 2 in a horizontal position.

Figure 6:
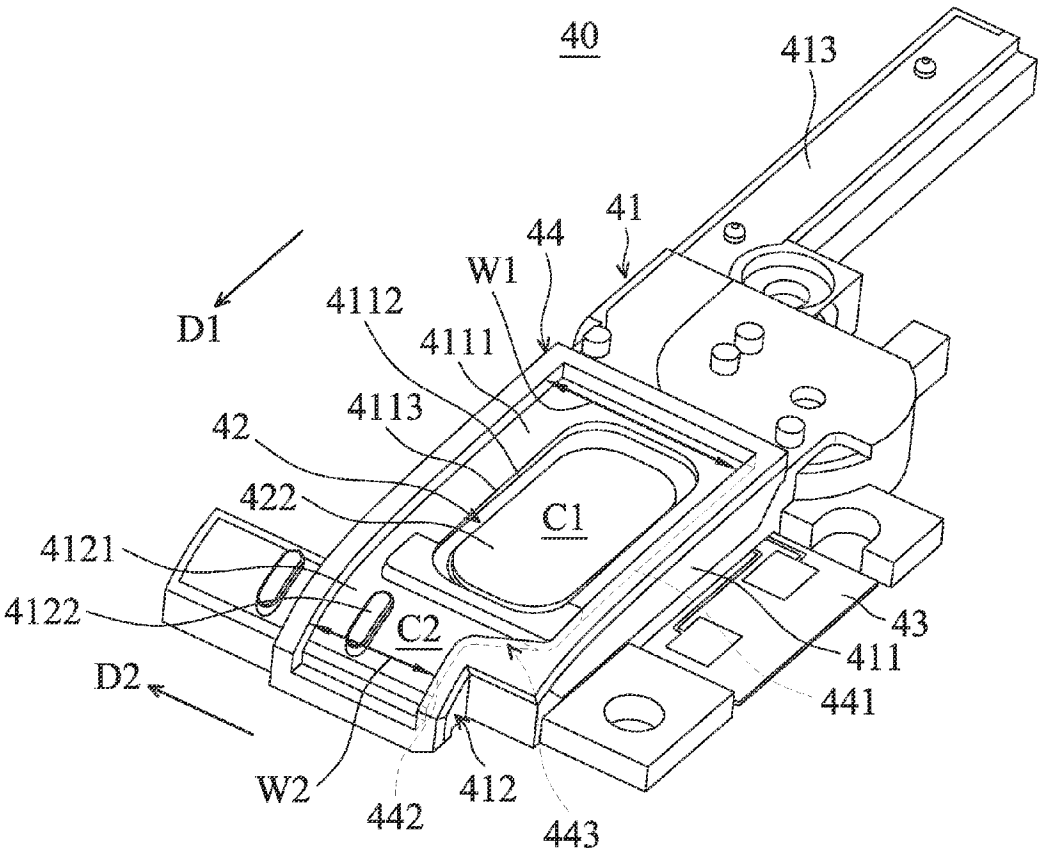
FIG. 6 is a perspective view of the acoustic assembly of the present disclosure.

FIG. 6 is a perspective view of the acoustic assembly 40 of the present disclosure. The acoustic assembly 40 includes a base 41, a speaker 42, a flexible printed circuit board 43, and a gasket 44. The base 41 is disposed in the cabinet 20 and located between the display panel 31 and the rear portion 22. The base 41 has a receiving portion 411, an inclined portion 412, and a fixing portion 413. The receiving portion 411 has a top surface 4111 and a receiving groove 4112. The top surface 4111 is parallel to the rear portion 22, and, namely, the top surface 4111 and the rear portion 22 are arc surfaces, and the curvature of the top surface 4111 and the rear portion 22 are the same. The receiving groove 4112 is formed on the top surface 4111, and the top surface 4111 has an opening 4113. In another case, the top surface 4111 and the rear portion 22 may be a plane.

The speaker 42 is disposed in the receiving groove 4112 of the receiving portion 411, and substantially extended along an extension direction D1. The speaker 42 includes a housing 421, a loudspeaker membrane 422, a magnetic element 423, a recess 424, and an electrode resilient tap 425. The housing 421 is disposed in the receiving groove 4112. The loudspeaker membrane 422 is disposed in the housing 421 and the receiving groove 4112, and corresponds to the opening 4113 of the receiving groove 4112. Therefore, the loudspeaker membrane 422 is exposed at the receiving portion 411 via the opening 4113. The distance between the loudspeaker membrane 422 and the rear portion 22 is from 0.3 mm to 1 mm. In the embodiment, the distance is about 0.5 mm.

The magnetic element 423 is disposed in the housing 421, and corresponds to the loudspeaker membrane 422. The loudspeaker membrane 422 vibrates due to the magnetic field generated by the magnetic element 423. The recess 424 is disposed on the bottom of the housing 421. The electrode resilient tap 425 and the magnetic element 423 are electrically connected to each other, disposed on the housing 421, and extended into the recess 424.

The flexible PCB (printed circuit board) 43 is disposed on the base 41. One end of the flexible PCB 43 extends into the recess 424, and is connected to the electrode resilient tap 425. The other end of the flexible PCB 43 protrudes out of the base 41.

The gasket 44 is substantially a square structure. The gasket 44 is disposed on the top surface 4111 of the receiving portion 411, and surrounds a part of the opening 4113 of the receiving groove 4112. The gasket 44 is located between the receiving portion 411 and the rear portion 22, and is connected to the top surface 4111 and the rear portion 22. The gasket 44 is made of rubber, plastic, or foam. The thickness of the gasket 44 is about 0.8 mm, and the thickness of the gasket 44 pressed by the receiving portion 411 and the rear portion 22 is about 0.5 mm.

A resonant chamber C1 is formed between the gasket 44, the top surface 4111 of the receiving portion 411, the loudspeaker membrane 422, and the rear portion 22. The loudspeaker membrane 422 is exposed at the resonant chamber C1. The volume of the resonant chamber C1 may be from 0.1 cc to 0.3 cc, and in the embodiments, the volume is about 0.2 cc.

The inclined portion 412 is connected to the receiving portion 411. The inclined portion 412 has an inclined surface 4121. An edge of the inclined surface 4121 is connected to the top surface 4111, and the opposite edge of the inclined surface 4121 is adjacent to the bottom of the acoustic hole 24. The gasket 44 is extended to the inclined surface 4121. A channel C2 is formed between the gasket 44, the inclined surface 4121 of the inclined portion 412, and the side wall 23. The channel C2 is an arc channel. The channel C2 communicates with the resonant chamber C1 and the acoustic hole 24, respectively. The volume of the channel C2 is from 0.05 cc to 0.2 cc, and in the embodiment, the volume is about 0.1 cc. In the embodiment, the ratio of the total volume of the resonant chamber C1 and the channel C2 to the volume of the speaker 42 is about 1:2.

The inclined surface 4121 is parallel to the side wall 23. Namely, the inclined surface 4121 corresponds to the curvature of the side wall 23. Thus, the inclined surface 4121 is an arc surface. In another case, if the side wall 23 is extended along a plane, the inclined surface 4121 is a plane. Therefore, the embodiment can be applied to variety of cabinet designs.

As shown in FIG. 5, the loudspeaker membrane 422 extends along a plane P1, and the plane P1 is located between the acoustic hole 24 and the rear portion 22. In FIG. 5, the plane P1 may be a horizontal plane. The acoustic hole 24 and the plane P1 are separated by a predetermined distance d1, and the predetermined distance d1 is from 1 mm to 1.5 mm. In the embodiment, the predetermined distance d1 is about 1.2 mm. In the conventional art, an acoustic hole must be located between the rear portion 22 and the plane P1. However, in the embodiment, the location of the acoustic hole 24 is lower than the loudspeaker membrane 422 of the speaker 42 due to the resonant chamber C1 and the channel C2 being formed between the base 41 and the cabinet 20. Thus, the thickness of the portable electronic device 2 is decreased.

The fixing portion 413 is substantially extended along the extension direction D1, and the fixing portion 413 is to help to fix the electronic component A1 of the cabinet 20. For example, the camera module shown in FIG. 4. Thus, the shape of the fixing portion 413 can correspond to the design of portable electronic device 2.

As shown in FIG. 6, the width W1 of the resonant chamber C1 is greater than the width W2 of the channel C2. The gasket 44 has a first surface 441 located at the receiving portion 4, a second surface 442 located at the inclined portion 412, and an inclined surface 443 connected to the first surface 441 and the second surface 442. The first and second surfaces 441 and 442 are parallel to each other, and the inclined surface 443 is inclined relative to the first and second surfaces 441 and 442. The standing wave, formed by the sound wave generated by the speaker 42, in the resonant chamber C1 and the channel C2 is decreased due to the inclined surface 443.

In addition, in the embodiment, the inclined portion 412 has a support lump 4122 disposed on the inclined surface 4121. The support lump 4122 is located between the mesh 26 and the inclined portion 412, to retain and support the mesh 26. In another embodiment, the support lump 4122 and the mesh 26 are selectively included in the smart mobile phone 100.

Figure 7:
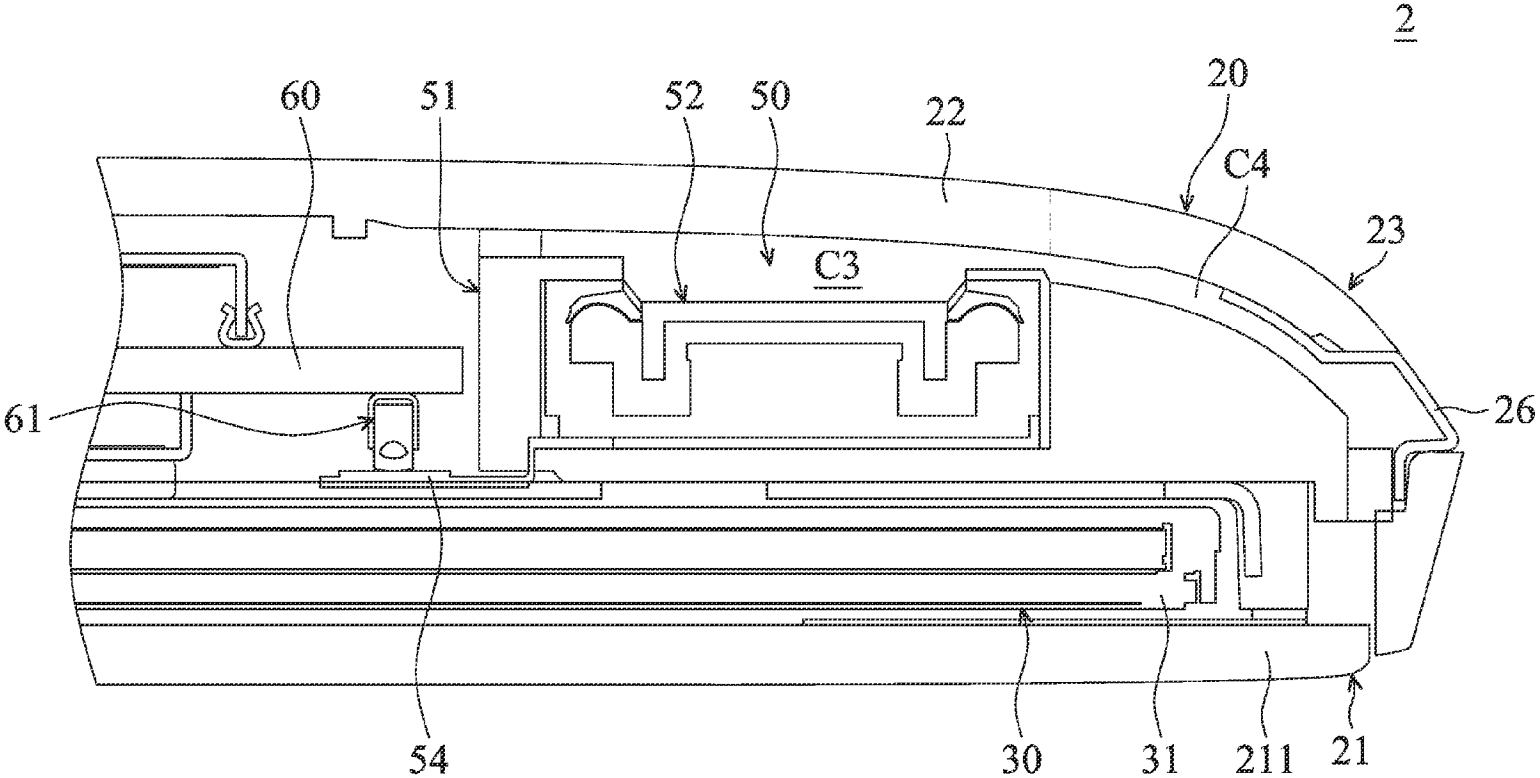
FIG. 7 is a cross-sectional view along the line BB of FIG. 4.
Figure 8:
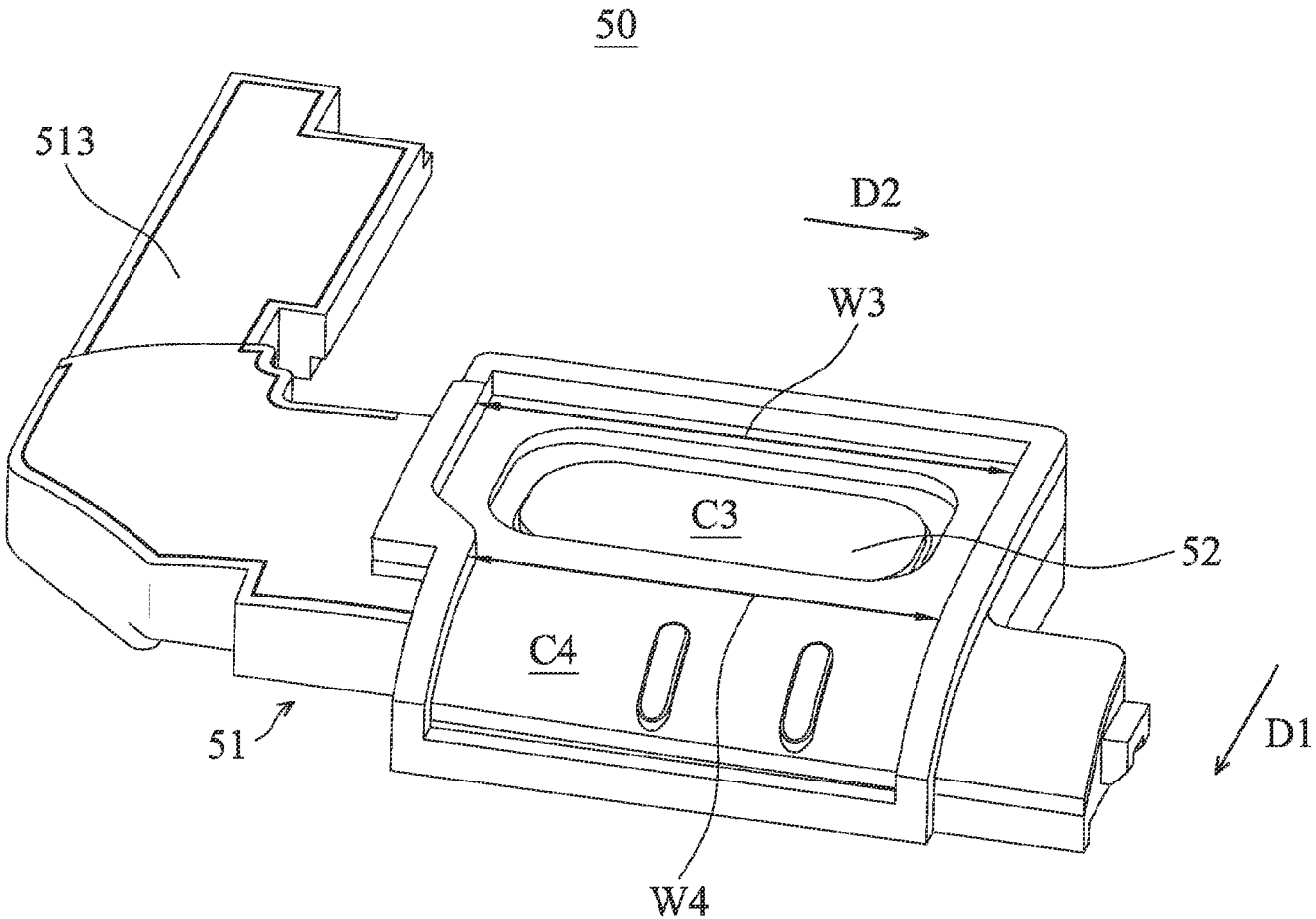
FIG. 8 is a perspective view of another acoustic assembly of the present disclosure.

FIG. 7 is a cross-sectional view along the line BB of FIG. 4. FIG. 8 is a perspective view of the acoustic assembly 50 of the present disclosure. The differences between the acoustic assembly 50 and the acoustic assembly 40 are described as follows. Corresponding to the inner design of the cabinet 20, the speaker 52 of the acoustic assembly 50 is extended along the extension direction D2, wherein the extension direction D2 is perpendicular to the extension direction D1. Thus, the width W3 of the resonant chamber C3 is wider than the width W1 of the resonant chamber C1, and the width W4 of the channel C4 is wider than the width W2 of the channel C2. The shapes of the fixing portion 513 of the base 51 and the fixing portion 413 of the base 41 may be different.

As shown in FIG. 7, the flexible PCB 54 is electrically connected to the main PCB 60 via an electrical connector 61. Thus, the main PCB 60 is located at the side of the speaker 52, but it is not located between the speaker 52 and the display panel 31. Since the thickness of the flexible printed circuit board 54 is muchless than the thickness of the main PCB 60*m*, thus, in the embodiment, the thickness of the portable electronic device 2 is further decreased by the flexible PCB 41.

In conclusion, the acoustic hole of the portable electronic device of the present disclosure is located at the side wall of the cabinet to increase the sound quality of the portable electronic device. In addition, by the resonant chamber and the channel formed between the base and the cabinet, the location of the acoustic hole can be lower than the loudspeaker membrane of the speaker. Thus, the thickness of the portable electronic device is decreased.

While the invention has been described by way of example and in terms of preferred embodiment, it is to be understood that the invention is not limited thereto. On the contrary, it is intended to cover various modifications and similar arrangements (as would be apparent to those skilled in the art). Therefore, the scope of the appended claims should be accorded the broadest interpretation so as to

What is claimed is:

1. A portable electronic device, comprising:

a cabinet, having a rear portion, a side wall connected to the rear portion, and an acoustic hole located at the side wall; and an acoustic assembly, comprising;

a base, disposed in the cabinet, having a receiving portion and an inclined portion connected to the receiving portion, wherein a channel is formed between the inclined portion and the side wall; and a speaker, disposed in the receiving portion, having a loudspeaker membrane, wherein a resonant chamber is formed between the loudspeaker membrane and the rear portion, and the channel communicates with the resonant chamber and the acoustic hole;

wherein the loudspeaker membrane is extended along a plane, the plane is located between the acoustic hole and the rear portion, and the acoustic hole and the plane are separated by a predetermined distance.

2. The portable electronic device as claimed in claim 1, wherein the predetermined distance is from 1 mm to 1.5 mm, and a distance between the loudspeaker membrane and the rear portion is from 0.3 mm to 1 mm.

3. The portable electronic device as claimed in claim 1, wherein the inclined portion has an inclined surface, and the channel is formed between the inclined surface and the side wall.

4. The portable electronic device as claimed in claim 3, wherein the arc surface is an arc surface, and the channel is an arc channel.

5. The portable electronic device as claimed in claim 1, wherein a volume of the resonant chamber is from 0.1 cc to 0.3 cc, and a volume of the channel is from 0.05 cc to 0.2 cc.

6. The portable electronic device as claimed in claim 1, wherein a ratio of a total volume of the resonant chamber and the channel to the volume of the speaker is about 1:2.

7. The portable electronic device as claimed in claim 1, further comprising a gasket located between the receiving portion and the rear portion, and the resonant chamber is located in the gasket, wherein the gasket has a first surface located at the receiving portion, a second surface located at the inclined portion, and an inclined surface connected to the first surface and the second surface, wherein the first and second surfaces are parallel to each other, and the inclined surface is inclined relative to the first and second surfaces.

8. The portable electronic device as claimed in claim 1, wherein the acoustic assembly further comprises a flexible printed circuit board disposed on the base, and the speaker further comprises an electrode resilient tap connected to the flexible printed circuit board.

9. The portable electronic device as claimed in claim 1, wherein a width of the resonant chamber is greater than a width of the channel.

10. The portable electronic device as claimed in claim 1, further comprising a display panel disposed in the cabinet, and the speaker is located between the rear portion and the display panel.

11. The portable electronic device as claimed in claim 10, further comprising a main printed circuit board disposed in the cabinet, and not located between the speaker and the display panel.

* * * * *